US006552687B1

(12) United States Patent
Rawnick et al.

(10) Patent No.: US 6,552,687 B1
(45) Date of Patent: Apr. 22, 2003

(54) ENHANCED BANDWIDTH SINGLE LAYER CURRENT SHEET ANTENNA

(75) Inventors: James J. Rawnick, Palm Bay, FL (US); Timothy E. Durham, Palm Bay, FL (US); William F. Croswell, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/052,288

(22) Filed: Jan. 17, 2002

(51) Int. Cl.[7] ..... H01Q 1/38

(52) U.S. Cl. ..... 343/700 MS; 343/776; 343/848

(58) Field of Search ..... 343/700 MS, 776, 343/829, 756, 846, 847, 848, 893, 778, 909

(56) References Cited

U.S. PATENT DOCUMENTS 3,761,943 A * 9/1973 Harper et al. ..... 343/776
5,434,580 A * 7/1995 Raguenet et al. .... 343/700 MS
5,485,167 A 1/1996 Wong et al. ..... 343/753
5,534,877 A * 7/1996 Sorbello et al. ..... 343/700 MS
6,175,333 B1 * 1/2001 Smith et al. ..... 343/700 MS
6,452,549 B1 * 9/2002 Lo ..... 343/700 MS
6,483,481 B1 * 11/2002 Sievenpiper et al. ..... 343/909

* cited by examiner

*Primary Examiner*—Hoanganh Le
*Assistant Examiner*—Shih-Chao Chen
(74) *Attorney, Agent, or Firm*—Akerman Senterfitt

(57) ABSTRACT

The invention concerns an array of radiating elements. A first plurality of antenna elements in a first plane in an array configuration is configured for operating on a first band of frequencies. A second plurality of planar antenna elements in an array configuration is configured for operating on a second frequency band, the second plurality of antenna elements is also positioned in the first plane. A first effective ground plane is provided for the first plurality of antenna elements and a second effective ground plane is provided for the second plurality of antenna elements. A first spacing between the first plurality of elements and the first effective ground plane is different from a second spacing between the second plurality of elements and the second effective ground plane. According to one embodiment, the second plurality of elements are adjacent to one another in a unitary cluster that is disposed within the first plurality of elements.

16 Claims, 6 Drawing Sheets

ENHANCED BANDWIDTH SINGLE LAYER CURRENT SHEET ANTENNA

BACKGROUND OF THE INVENTION

1. Technical Field

The present invention relates to the field of array antennas and more particularly to array antennas having extremely wide bandwidth.

2. Description of the Related Art

Phased array antenna systems are well known in the antenna art. Such antennas are generally comprised of a plurality of radiating elements that are individually controllable with regard to relative phase and amplitude. The antenna pattern of the array is selectively determined by the geometry of the individual elements and the selected phase/amplitude relationships among the elements. Typical radiating elements for such antenna systems may be comprised of dipoles, slots or any other suitable arrangement.

In recent years, a variety of new planar type antenna elements have been developed which are suitable for use in array applications. One example of such an element is disclosed in U.S. application Ser. No. 09/703,247 to Munk, et al. entitled Wideband Phased Array Antenna and Associated Methods (hereinafter "Munk"). Munk discloses a planar type antenna-radiating element that has exceptional wideband characteristics. In order to obtain exceptionally wide bandwidth, Munk makes use of capacitive coupling between opposed ends of adjacent dipole antenna elements. Bandwidths on the order of 9-to-1 are achievable with the antenna element with the Munk et al. design. Analysis has shown the possibility of 10-to-1 bandwidths achievable with additional tuning. However, this appears to be the limit obtainable with this particular design.

Although the Munk et al. antenna element has a very wide bandwidth for a phased array antenna, there is a continued need and desire for phased array antennas that have even wider bandwidths exceeding 10-to-1. Past efforts to increase the bandwidth of a relatively narrow-band phased array antenna have used various techniques, including dividing the frequency range into multiple bands.

For example, U.S. Pat. No. 5,485,167 to Wong et al. concerns a multi-frequency phased array antenna using multiple layered dipole arrays. In Wong et al., several layers of dipole pair arrays are provided, each tuned to a different frequency band. The layers are stacked relative to each other along the transmission/reception direction, with the highest frequency array in front of the next lowest frequency array and so forth. In Wong et al., a high band ground screen, comprised of parallel wires disposed in a grid, is disposed between the high-band dipole array and a low band dipole array.

Wong's multiple layer approach has two drawbacks. The dual layer approach makes manufacturing and connecting the elements more difficult due to the embedded interconnects of a multiple layer antenna. Second, in a multiple layer antenna the upper elements will present some amount of blockage to the lower (closer to the ground plane) elements. Moreover, conventional dipole arrays as described in Wong et al. have a relatively narrow bandwidth such that the net result of such configurations may still not provide a sufficiently wideband array. Accordingly, there is a continuing need for improvements in wideband array antennas that have a bandwidth exceeding 10-to-1.

SUMMARY OF THE INVENTION

The invention concerns an array of radiating elements. A first plurality of antenna elements in a first plane in an array configuration is configured for operating on a first band of frequencies. A second plurality of planar antenna elements in an array configuration is configured for operating on a second frequency band, the second plurality of antenna elements is also positioned in the first plane. A first effective ground plane is provided for the first plurality of antenna elements and a second effective ground plane is provided for the second plurality of antenna elements. A first spacing between the first plurality of elements and the first effective ground plane is different from a second spacing between the second plurality of elements and the second effective ground plane. According to one embodiment, the second plurality of elements are adjacent to one another in a unitary cluster that is disposed within the first plurality of elements.

The array can also comprise a plurality of RF feed points connected to the first and second plurality of antenna elements and a controller for controlling phase and/or amplitude of RF applied to the radiating elements at the feed points. This configuration allows the array to be scanned as needed to advantageously direct the received or transmitted RF energy.

According to one aspect of the invention, the first plurality of elements can be low band antenna elements for operating on a lower band of frequencies, whereas the second plurality of elements are high band antenna elements for operating on a relatively higher band of frequencies. In that case, the first spacing is greater than the second spacing.

According to yet another aspect of the invention, the second plurality of antenna elements can define a high frequency cluster or antenna elements. A plurality of such high frequency clusters can be disposed among the first plurality of antenna elements. Each of the high frequency clusters can be configured to operate on the same band of frequencies or can be configured for a band of frequencies distinct from other high frequency clusters.

A ground plane stepped portion can be provided where the first effective ground plane transitions from the first spacing to the second spacing defining the second effective ground plane. Alternatively, the second effective ground plane can be a low pass frequency selective surface interposed between the second plurality of antenna elements and the first effective ground plane. In any case, at least one dielectric layer is preferably interposed between the first plane, where the first and second plurality of antenna elements are located, and the respective effective ground planes for each set of elements.

According to one embodiment, one or both of the first and second plurality of antenna elements can comprise an elongated body portion, and an enlarged width end portion connected to an end of the elongated body portion. The enlarged width end portions of adjacent ones of the antenna elements comprise interdigitated portions. More particularly, the plurality of antenna elements can be comprised of adjacent dipole elements, and an end portion of each dipole element can be capacitively coupled to a corresponding end portion of an adjacent dipole element.

BRIEF DESCRIPTION OF THE DRAWINGS

The various features and advantages of the present invention may be more readily understood with reference to the following drawings in which like reference numerals designate like structural elements.

DETAILED DESCRIPTION OF THE INVENTION

Figure 1:
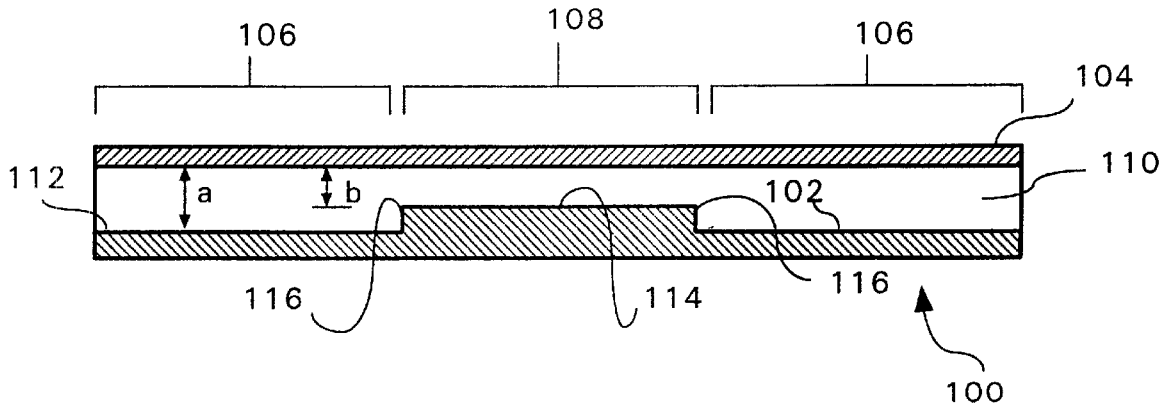
FIG. 1 is a cross-sectional view of a dual-band, single layer array with a single high frequency cluster.
Figure 2:
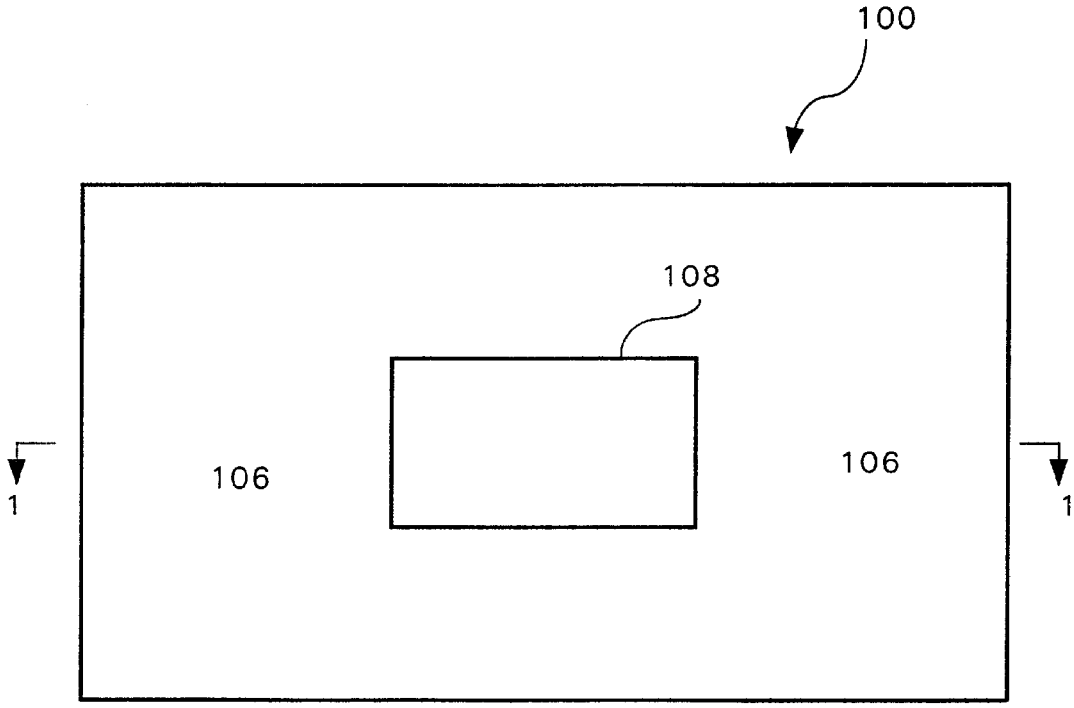
FIG. 2 is a top view of the dual band, single layer array of FIG. 1.

FIGS. 1 and 2 illustrate a dual-band, single layer array 100. FIG. 2 is a top view of the array. FIG. 1 is a cross-sectional view taken along line 1—1 in FIG. 2. Array 100 is comprised of a ground plane 102 and a plurality of antenna elements (not shown) that are disposed on a surface 104. A dielectric material 110 is provided in the volume defined between the ground plane 102 and surface 104. A plurality of antenna element feed points are preferably provided for each of the antenna elements of the array 100, but have been omitted in FIGS. 1 and 2 for greater clarity.

According to a preferred embodiment, a first plurality of low frequency antenna elements is preferably disposed in an area 106 of the array and a second plurality of high frequency antenna elements is preferably disposed in an area 108 of the array. The ground plane 102 comprises a first effective ground plane portion 112 provided for the first plurality of antenna elements beneath area 106, and a second effective ground plane portion 114 provided beneath area 108 for the second plurality of antenna elements.

As shown in FIG. 1, a first spacing "a" between the first effective ground plane portion 112 and the surface 104 is greater as compared to a second spacing "b" between the second effective ground plane portion 114 and surface 104. A ground plane stepped portion 116 is provided where the first effective ground plane portion 112 transitions from the first spacing "a" to the second spacing "b" defining the second effective ground plane 114.

Those skilled in the art will recognize that the larger spacing "a" in the area 106 facilitates proper operation of the low frequency antenna elements in this portion of the array 10. Conversely, the smaller spacing "b" in the area 108 facilitates proper operation of the high frequency antenna elements. The particular spacing selected in each case will generally be determined by a variety of factors including the operating frequency, the thickness of the antenna elements, and the dielectric constant of the particular dielectric material 110.

The particular dielectric material 110 selected for use in the present invention is not critical. Any of a variety of commonly used dielectric materials may be used for this purpose, although low loss dielectrics are preferred. For example, one suitable class of materials would be polytetrafluoroethylene (PTFE) based composites such as RT/duroid® 6002 (dielectric constant of 2.94; loss tangent of 0.009) and RT/duroid® 5880 (dielectric constant of 2.2; loss tangent of 0.0007). These products are both available from Rogers Microwave Products, Advanced Circuit Materials Division, 100 S. Roosevelt Ave, Chandler, Ariz. 85226. However, the invention is not limited in this regard.

The array configuration described in FIGS. 1 and 2 is advantageous as it permits antenna arrays for two separate bands of frequencies to be integrated so as to form a single dual-band array with two sets of antenna elements in a common plane defined by surface 104. Designing the frequency response of the high frequency antenna elements to begin approximately where the response of the low frequency antenna elements cuts off can provide an antenna with apparently wider bandwidth. Despite the advantages of the foregoing arrangement, however, use of conventional narrow-band antenna elements in such an array will still result in an overall bandwidth that is somewhat limited. In particular, the limited frequency range of the respective high frequency and low frequency antenna elements used in each array will limit the ultimate combined bandwidth of the array.

Figure 8:
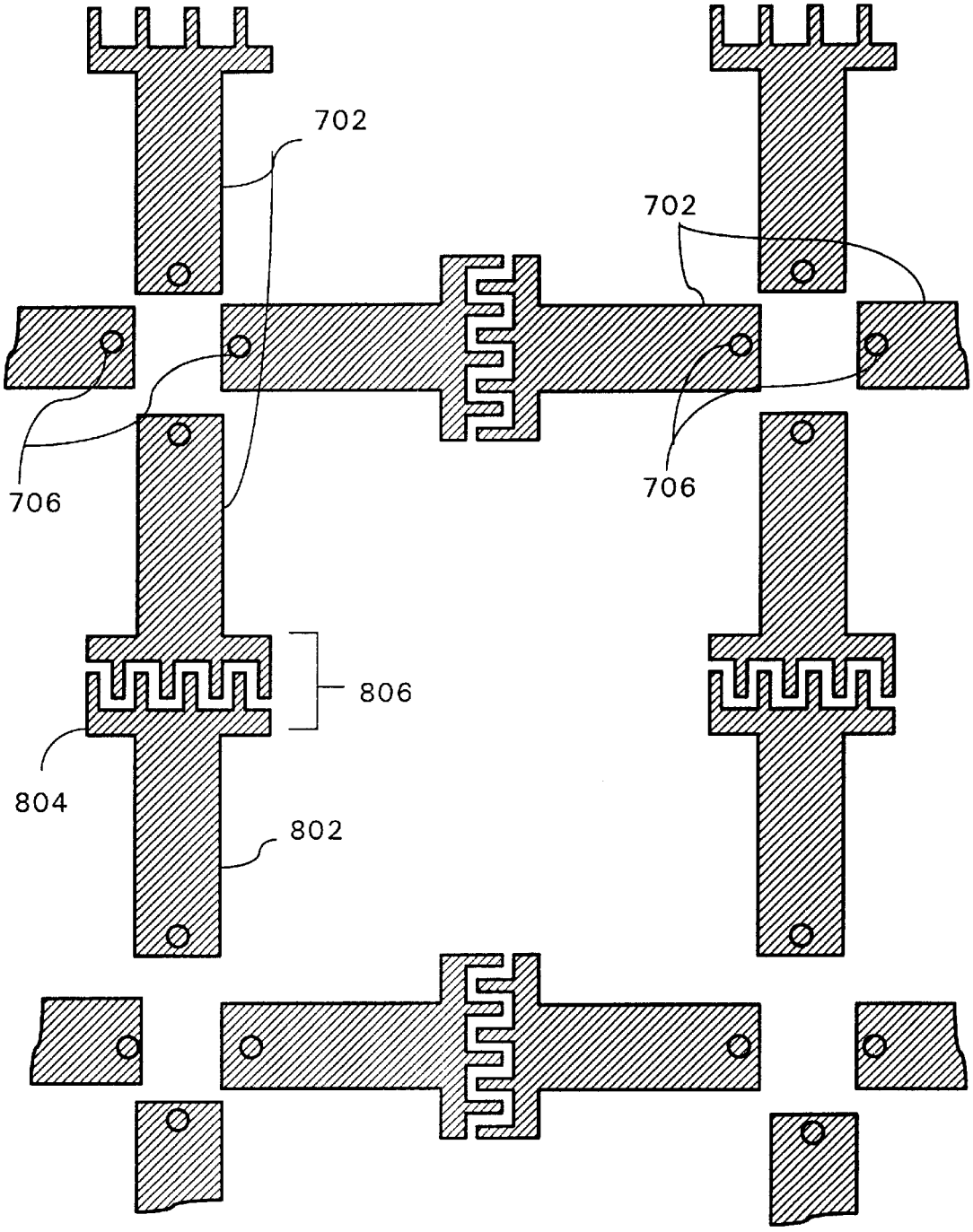
FIG. 8 is a drawing useful for illustrating an exemplary wideband antenna element for use with the arrays of FIGS. 1–6.

The foregoing limitations can be overcome and further advantage in broadband performance can be achieved by proper selection of antenna elements. U.S. application Ser. No. 09/703,247 to Munk et al. entitled Wideband Phased Array Antenna and Associated Methods ("Munk et al.), incorporated herein by reference, discloses such a dipole antenna element. For convenience, one embodiment of these elements is illustrated in FIG. 8. Thus, one or both of the first and second plurality of antenna elements can comprise dipole pairs having a configuration similar to elements 702 in FIG. 8. For example, the dipole pairs can have an elongated body portion 802, and an enlarged width end portion 804 connected to an end of the elongated body portion. The enlarged width end portions of adjacent ones of the antenna elements comprise interdigitated portions 806. Consequently, an end portion of each dipole element can be capacitively coupled to a corresponding end portion of an adjacent dipole element. The low frequency elements used in the array are preferably of a similar geometry and configuration to that shown in FIG. 8, but appropriately sized so as to accommodate the lower frequency band of operation.

When used in an array, the dipole element of Munk et al., has been found to provide remarkably wideband performance. The wideband performance of such antenna elements can be used to advantage in the present invention. In particular, high frequency band and low frequency band elements of the type described in Munk et al can be disposed in an array as described relative to FIGS. 1 and 2 herein.

In general, the Munk et al. antenna concept benefits from capacitive coupling of individual dipole antenna elements to neighboring antenna elements. In FIGS. 1 and 2, placing a high frequency cluster in the midst of the low frequency array creates a discontinuity that can interfere with this coupling. This discontinuity can negatively impact on the performance of the low band array if proper precautions are not taken in the overall antenna system design.

Degradation to the low frequency array can be minimized if the discontinuity created by the high frequency array is relatively small in terms of the wavelength of the low frequency array. In general, a relatively small discontinuous area in the low frequency array will not severely impact the performance of the array.

The precise maximum area of a discontinuity that can be occupied by the high frequency array without substantial degradation of the low frequency array, can be determined experimentally or using computer modeling. However, the discontinuity created by the high frequency array is preferably less than about two (2) wavelength square, where the wavelength is determined based on the operational frequency of the low-band array.

The foregoing limitations will restrict the maximum preferred size of area defining the discontinuity formed by high frequency array. For example, this factor would limit the size of area 108 in FIG. 2. If additional high frequency antenna elements are needed to form the high frequency array, then it is necessary to provide a separate discontinuity in the low frequency array some distance away from the first discontinuity.

Figure 3:
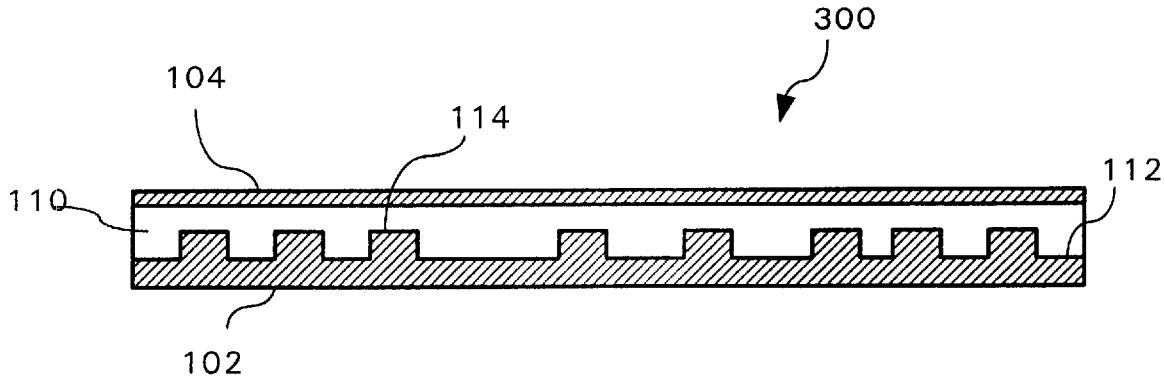
FIG. 3 is a cross-sectional view of a dual-band single layer array with a plurality of high frequency clusters.
Figure 4:
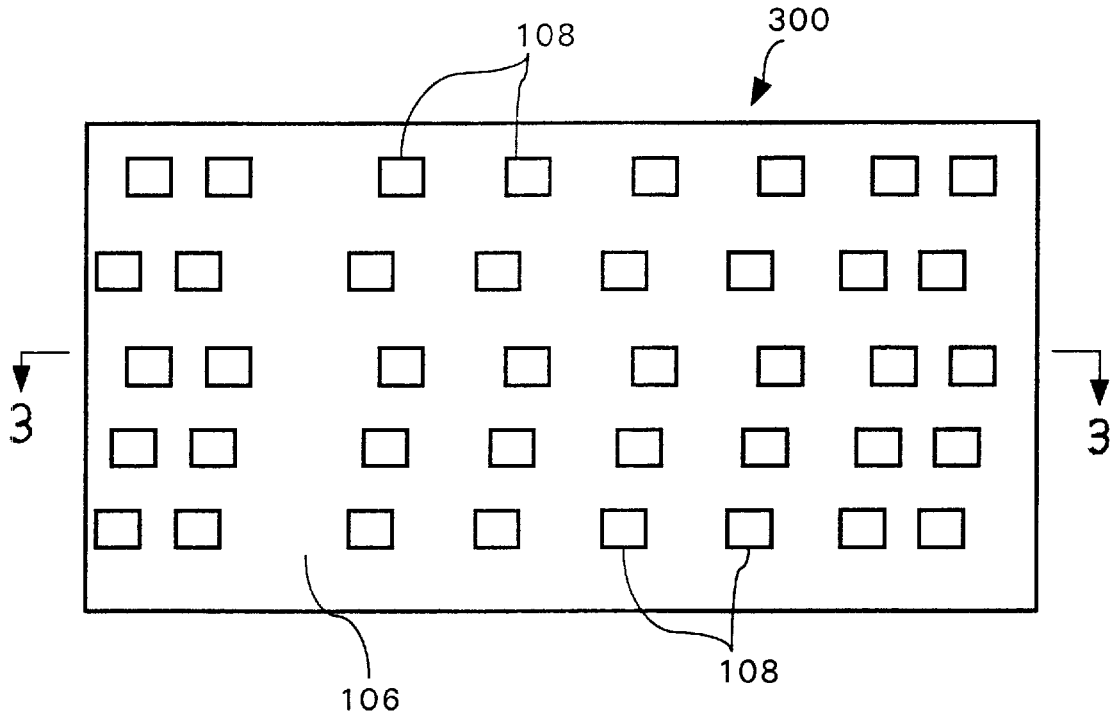
FIG. 4 is a top view of the array in FIG. 3.

FIGS. 3 and 4 illustrate an alternative embodiment of a dual-band single layer array 300 similar to the arrangement in FIGS. 1 and 2. FIG. 4 is a top view of the array and FIG. 3 is a cross-sectional view taken along line 3—3. As shown in FIGS. 3 and 4 the array can comprise a plurality of areas 108 where high frequency elements are clustered.

One difficulty associated with the arrangement in FIGS. 3 and 4 is that a large distance (electrically) can separate two or more discontinuous areas 108 forming the high frequency array. This can lead to grating lobe problems if all of the high frequency elements are used concurrently to form a single array. However the problem can be minimized where the pattern of areas 108 of high frequency clusters is aperiodic. Generally speaking, an array of elements arranged in an aperiodic lattice can be placed further apart from each other, as compared to a conventional rectangular or triangular lattice, to achieve the same grating-lobe-free scan.

Grating lobes are a mathematical image of the main beam of a phased array that can appear when the beam of an array is scanned too far. It is dependent on element spacing. If the elements are spaced a half wavelength apart then at that frequency the beam can be scanned anywhere in the hemisphere in front of the array (+/−90 degrees). If you space the elements one wavelength apart then the grating lobe resides at the edge of visible space and any scanning of the beam will bring the grating lobe fully into visible space. An aperiodic lattice allows the elements to be spaced farther apart and still permit a grating-lobe-free scan. For example, the clusters of high frequency elements in areas 108 could be spaced a wavelength or more apart without creating a grating lobe problem. The benefits of aperiodic lattices are generally known in the art, but have not generally been applied as described herein.

Figure 5:
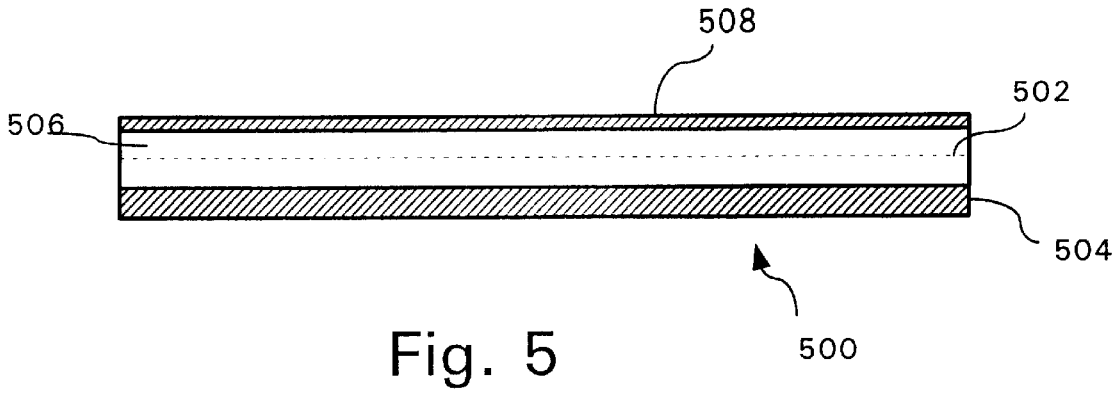
FIG. 5 is a cross-sectional view of an alternative embodiment of a dual band, single layer array.
Figure 6:
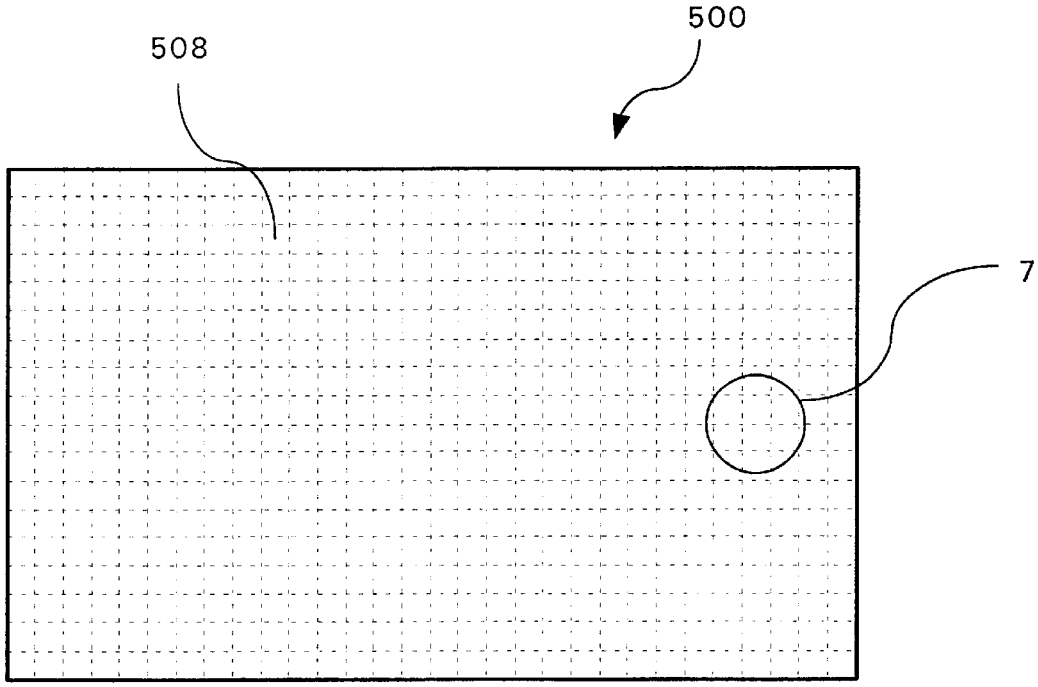
FIG. 6 is a top view of the array of FIG. 5.

FIG. 5 is a cross-sectional view of an alternative embodiment of a dual-band, single layer approach. FIG. 6 is a top view of the dual-band array of FIG. 5. As shown in FIG. 5, the effective ground plane for the high frequency elements in the array can be provided by a frequency selective surface 502. The second effective ground plane 504 for the low frequency elements in the array can be provided by a conventional metal ground plane formed of copper cladding or the like. A suitable dielectric material as described above in relation to FIGS. 1 and 2 can be provided between the ground plane 504 and the frequency selective surface 502. Similarly a suitable dielectric material can be provided between the frequency selective surface 502 and the surface 508 on which the antenna elements are disposed.

The frequency selective surface 502 can be comprised of any layer that is designed to pass the lowband frequencies associated with the low frequency array 704 elements, but is opaque (i.e. acts as a bandstop) for the higher frequency range on which the elements 702 operate. In this regard, it may be desirable to design the frequency selective surface to have a bandstop range of frequencies somewhat higher than the operating range of the higher frequency elements 702 in order to account for anticipated rolloff in the frequency response of the surface.

According to a preferred embodiment, a conventional wire or slot arrangement can be used for the frequency selective surface 502, as is known in the art. The actual design of a suitable frequency selective surface 502 is well documented in the reference Frequency Selective Surfaces, Ben A. Munk, Copyright 2000 by John Wiley, & Sons. However, the invention is not limited to the specific frequency selective surface disclosed therein. Accordingly, other frequency selective surfaces can also be used for this purpose.

Figure 7:
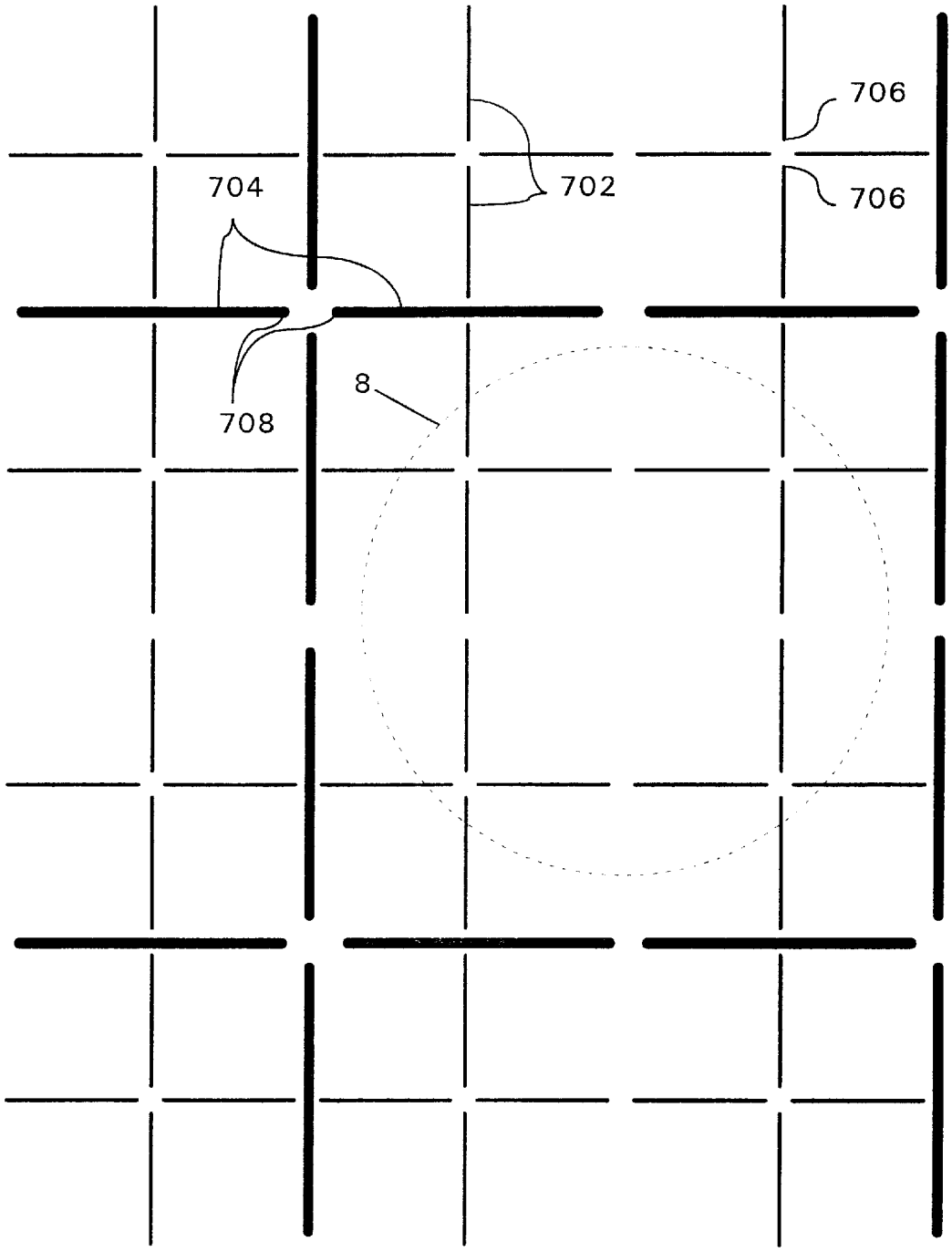
FIG. 7 is a schematic representation showing the interlaced formation of the higher and lower frequency elements.

FIG. 7 is an enlarged schematic representation of the surface 508 showing the interlaced formation of the higher frequency dipole elements 702 and lower frequency dipole elements 704. Lower frequency elements 704 and higher frequency elements 702 can be arranged in separate dual polarized grid patterns of spaced rows and columns as shown. Feed points 706, 708 are provided for communicating RF to and from the respective elements 702, 704.

In the embodiment of FIGS. 5–7, the first and second pluralities of antenna elements are preferably interlaced, rather than arranged in clusters formed in areas 108. The interlaced approach does away with the need for the aperiodic clusters and avoids creating a discontinuity in the low frequency array. This can be an advantage as it avoids some of the potential problems associated with grating lobes. The disadvantage to this interlaced approach is that both the low frequency and high frequency elements 704, 702 are in very close proximity and can potentially couple to each other. At a minimum, the relatively high density of antenna elements etched on the substrate can affect how the elements operate. For example, a few high frequency elements tucked inside a low frequency element will not necessarily perform the same way as the same high frequency elements in isolation. The benefits and disadvantages of clustered approach in FIGS. 1–4 can therefore be considered and traded off as part of the actual design of a particular array. The best embodiment for a particular application will generally depend upon the requirements that are to be met.

The number of high frequency elements 702 interposed between the low frequency elements 704 will depend upon the operating frequency and bandwidth of frequencies for the respective low and high frequency elements. In FIG. 7, only four high frequency elements 702 are provided between adjacent low frequency elements 704. However, the invention is not so limited and other configurations are also possible.

The specific geometry or type of the radiating elements 702, 704 is not critical for dual band operation. According to a preferred embodiment, however, antenna elements having the geometry and characteristics of those disclosed in Munk et al. can be used for achieving a very broad bandwidth. For convenience, one embodiment of the elements as described in Munk et al. is shown in FIG. 8. However, it will be appreciated that other types of antenna elements can also be used for this purpose. Antenna elements 704 are preferably of a similar geometry and configuration, but appropriately sized so as to accommodate the lower frequency band of operation.

Figure 9:
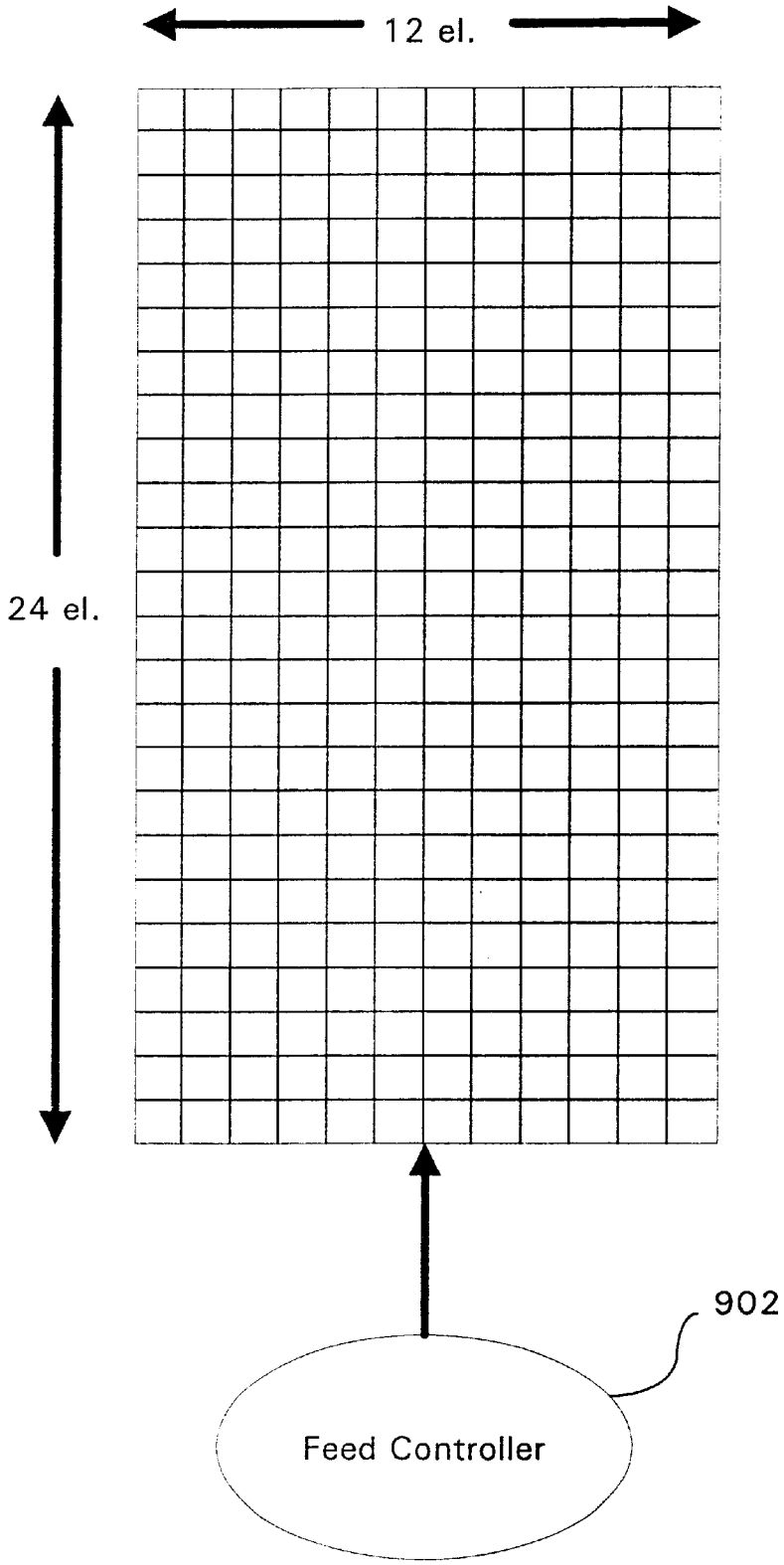
FIG. 9 is an example of a phased array antenna system.

FIG. 9 is an example of how the array antennas of FIGS. 1–7 can be used. A feed controller 902 is conventionally provided for controlling the scanning of a beam formed by the array. The feed controller 902 connects the array to transmitting and receiving equipment. The feed controller 902 conventionally contains feed lines and phase shifters in communication with the feed points of the respective antenna elements for controlling the scanning of the beam.

It will be recognized by those skilled in the art that the foregoing embodiments are merely illustrative of the many specific embodiments that represent applications of the invention. Those skilled in the art can readily devise numerous alternative arrangements without departing from the scope of the invention.

We claim:

1. A unitary array of radiating elements comprising:

a first plurality of antenna elements in a first plane in an array configuration, said first plurality of planar antenna elements configured for operating on a first band of frequencies;

a second plurality of planar antenna elements in a second array configuration, said second plurality of antenna elements configured for operating on a second band of frequencies, said second plurality of antenna elements positioned in said first plane interposed among said first plurality of planar antenna elements;

a first effective ground plane for said first plurality of antenna elements;

a second effective ground plane for said second plurality of antenna elements;

and wherein a first spacing between said first plurality of elements and said first effective ground plane is different from a second spacing between said second plurality of elements and said second effective ground plane.

2. The array according to claim 1 wherein said second plurality of elements are formed adjacent to one another in a cluster, said cluster disposed within said first plurality of elements.

3. The array according to claim 1 further comprising:

a plurality of RF feed points connected to said first and second plurality of antenna elements; and a controller for controlling at least one of a phase and amplitude of RF applied to said radiating elements at said feed points.

4. The array according to claim 1 wherein said first plurality of elements are low band antenna elements for operating on a lower band of frequencies, said second plurality of elements are high band antenna elements for operating on a relatively higher band of frequencies, and said first spacing is greater than said second spacing.

5. The array according to claim 1 further comprising a ground plane stepped portion where said first effective ground plane transitions from said first spacing to said second spacing defining said second effective ground plane.

6. The array according to claim 1 wherein said second effective ground plane is a low pass frequency selective surface interposed between said second plurality of antenna elements and said first effective ground plane.

7. The array according to claim 1 wherein said first plurality of antenna elements are interlaced with said second plurality of antenna elements.

8. The array according to claim 1 further comprising at least one dielectric layer interposed between said first plane, and said first and second effective ground planes.

9. The array according to claim 1 wherein at least one of said first and second plurality of antenna elements comprise:

an elongated body portion; and an enlarged width end portion connected to an end of the elongated body portion.

10. The array according to claim 9 wherein said enlarged width end portions of adjacent ones of said antenna elements comprise interdigitated portions.

11. The array according to claim 1 wherein at least one of said first and second plurality of antenna elements are comprised of adjacent dipole elements, and an end portion of each dipole element is capacitively coupled to a corresponding end portion of an adjacent dipole element.

12. The array according to claim 1 wherein said second plurality of antenna elements defines a high frequency cluster, and said array comprises a plurality of said high frequency clusters disposed among said first plurality of antenna elements.

13. The array according to claim 12, wherein said high frequency clusters are disposed in an aperiodic pattern.

14. An array of radiating elements comprising:

a first plurality of antenna elements in a first plane positioned adjacent to one another in an array, said first plurality of planar antenna elements configured for operating on a first band of frequencies;

a second plurality of planar antenna elements adjacent to one another in an array configuration and forming a cluster within said first plurality of antenna elements, said second plurality of antenna elements positioned in said first plane interposed among said first plurality of planar antenna elements and configured for operating on a second band of frequencies distinct from said first band of frequencies;

a first effective ground plane for said first plurality of antenna elements;

a second effective ground plane for said second plurality of antenna elements;

and wherein said first plurality of elements are low band antenna elements for operating on a lower band of frequencies, said second plurality of elements are high band antenna elements for operating on a relatively higher band of frequencies, and a first spacing between said first plurality of elements and said first effective ground plane is different from a second spacing between said second plurality of elements and said second effective ground plane.

15. The array according to claim 14 further comprising a ground plane stepped portion where said first effective ground plane transitions from said first spacing to said second spacing defining said second effective ground plane.

16. An array of radiating elements comprising:

a first plurality of antenna elements in a first plane positioned adjacent to one another in an array, said first plurality of planar antenna elements configured for operating on a first band of frequencies;

a second plurality of planar antenna elements adjacent to one another in an array configuration, said second plurality of antenna elements positioned in said first plane interlaced among said first plurality of planar antenna elements and configured for operating on a second band of frequencies distinct from said first band of frequencies;

a first effective ground plane for said first plurality of antenna elements;

a second effective ground plane for said second plurality of antenna elements;

a first spacing between said first plurality of elements and said first effective ground plane different from a second spacing between said second plurality of elements and said second effective ground plane; and wherein said second effective ground plane is a low pass frequency selective surface interposed between said second plurality of antenna elements and said first effective ground plane.

* * * * *